US005269644A

United States Patent [19]

Vatel

[11] Patent Number: 5,269,644

[45] Date of Patent: Dec. 14, 1993

[54] LOAD BALANCING MANIPULATOR

[76] Inventor: Bronislav Vatel, 3730 Countryside La., Glenview, Ill. 60025

[21] Appl. No.: 913,063

[22] Filed: Jul. 14, 1992

[51] Int. Cl.[5] ..... B66C 23/36

[52] U.S. Cl. ..... 414/744.3; 414/744.8; 901/15

[58] Field of Search ..... 414/744.1, 744.3, 744.5, 414/744.8; 901/15, 49

[56] References Cited

U.S. PATENT DOCUMENTS

| | | | |
|---|---|---|---|
| 2,188,364 | 1/1940 | Lannen | 121/46 |
| 3,266,379 | 8/1966 | Kreuter | 91/374 |
| 3,457,836 | 7/1969 | Henderson | 91/380 |
| 3,554,091 | 1/1971 | Spyridakis et al. | 91/428 |
| 3,893,373 | 7/1975 | Bernd et al. | 91/35 |
| 4,033,233 | 7/1977 | Toi | 91/374 |
| 4,428,710 | 1/1984 | Griesbach et al. | 414/590 |
| 4,767,257 | 8/1988 | Kato | 414/744.5 |
| 4,859,135 | 8/1989 | Neufeldt | 414/572 |
| 5,000,653 | 3/1991 | Gosdowski | 414/744.5 |

OTHER PUBLICATIONS

WO82/02019, PCT/JP81/00377, Jun. 24, 1982, Inaba et al.

*Primary Examiner*—Michael S. Huppert
*Assistant Examiner*—Donald W. Underwood
*Attorney, Agent, or Firm*—H. Jay Spiegel

[57] ABSTRACT

A load balancing manipulator is disclosed which allows the user great flexibility in moving heavy objects from place to place. The invention is supported on a base having an upstanding post to which is attached a pivoting arm having a second pivoting arm attached at a distal end of the first-mentioned arm. At the end of the second arm, a load manipulator is provided including a pneumatic cylinder-piston arrangement and a sleeve actuator for switches which, when closed, activate solenoid valves which control supply and exhaust of air to and from the cylinder, respectively. In the preferred embodiment, an electromagnet is used to hold a load in place. Battery back-up and load safety mechanism for the electromagnet are also provided.

14 Claims, 4 Drawing Sheets

LOAD BALANCING MANIPULATOR

BACKGROUND OF THE INVENTION

The present invention relates to a load balancing manipulator. In the prior art, various load handling mechanisms are known. However, Applicant is unaware of any such device including all of the features and aspects of the present invention.

The following prior art is known to Applicant:

U.S. Pat. Nos. 4,428,710 to Grisebach et al., 4,767,257 to Kato, 4,859,139 to Torii et al. and 5,000,653 to Gosdowski each teach a load handling device including mutually pivoting arms and some support structure. Gosdowski teaches such a device having an electrical drive 36 for the gripping device 38. Grisebach et al. teach a load handler having vertical adjustment through the use of a rack and pinion or screw-type actuator. The present invention differs from the teachings of these patents as contemplating a unique combination of a sleeve-type actuator for electrical switches which cause operation of solenoid valves to control flow of fluid pressure in and out of a cylinder.

U.S. Pat. No. 2,188,364 to Lannen discloses a load lifter and balancer wherein valves are manually actuated to control supply and exhaust to and from a cylinder to raise and lower a hook 8. The present invention differs from the teachings of Lannen as contemplating a unique sleeve-type actuator which directly actuates electrical switches which control operation of solenoid valves controlling supply and exhaust to and from a cylinder.

U.S. Pat. No. 3,554,091 to Spyridakis et al. discloses a switch device comprising a sleeve which is balanced through the use of springs 27 to a central position. The sleeve directly carries valve heads 21 which activate responsive to movements of the sleeve to directly control fluid flow. The present invention differs from the teachings of Spyridakis et al. as contemplating a sleeve actuator designed to actuate electrical switches which cause remote controlling of solenoid valve actuators.

U.S. Pat. Nos. 3,266,379 to Kreuter, 3,457,836 to Henderson, 3,893,373 to Bernd et al. and 4,033,233 to Toi disclose various fluid-based power systems. Kreuter teaches an electro-pneumatic control mechanism while Henderson teaches an electro-hydraulic control system. Bernd et al. contemplate the use of hydraulic fluid and a programming system. Toi also contemplates hydraulic fluid. The present invention differs from the teachings of these patents as contemplating a unique combination of a sleeve actuator actuating electrical switches which control operation of solenoid valves controlling supply and exhaust of a pneumatic cylinder.

SUMMARY OF THE INVENTION

The present invention relates to a load balancing manipulator. The present invention includes the following interrelated objects, aspects and features:

(A) In a first aspect, in the preferred embodiment of the present invention, the inventive device includes a base which is secured on a ground surface, an upstanding post, a first arm pivotably mounted to the post, and a second arm pivotably mounted to the first arm.

(B) At the distal end of the second arm, with respect to the post, a vertical support is provided which carries a pneumatic piston-cylinder arrangement, an electromagnet or other tooling as well as a control mechanism. Besides the electromagnet, alternatives include a mechanical hook, a pneumatic gripper or hook, or a vacuum lifter.

(C) The control mechanism consists of a vertically disposed sleeve which is balanced in a central position by virtue of two springs. The sleeve defines an internal chamber which carries two inductive proximity switches as well as, if desired, an on-off switch for the electromagnet or other tooling. Movement of the sleeve upwardly causes closure of a first such proximity switch while movement of the sleeve downwardly causes opening of the first-mentioned proximity switch and closure of the second such switch. Of course, upward movements of the sleeve in a direction of closure of the first proximity switch cause opening of the second-mentioned proximity switch.

(D) In accordance with the electrical circuitry of the present invention, movement of the sleeve upwardly causes closure of the upper proximity switch resulting in operation of a solenoid valve to an open position thereof allowing supply of air into the cylinder causing the piston, piston rod and magnet attached thereto to be raised. Movement of the sleeve downwardly opens the upper proximity switch and closes the lower proximity switch causing closure of the first-mentioned solenoid valve and opening of a second solenoid valve to thereby allow exhaust of the cylinder and lowering of the piston, piston rod and magnet through operation of gravitational forces.

(E) The electrical circuitry also includes 1) a battery back-up so that, if power is lost, the battery will maintain power to the electromagnet for a sufficiently long enough period of time to permit safe lowering of a load to a ground surface to prevent release of the load and injury to the user and 2) a normally closed proximity switch for the load safety mechanism to prevent accidental tooling release when a load is in the air and power is lost. The electrical and pneumatic circuitry of the present invention also includes safety devices to prevent sudden lowering of a load if air supply is interrupted.

As such, it is a first object of the present invention to provide a load balancing manipulator.

It is a further object of the present invention to provide such a device carried on a series of pivotable arms mounted on a post.

It is a still further object of the present invention to provide such a device including a balanced sleeve actuator for inductive proximity switches which control operation of solenoid valves controlling supply and exhaust to and from a pneumatic cylinder.

It is a still further object of the present invention to provide such a device including a battery back-up for safety purposes.

It is a still further object of the present invention to provide such a device including a load safety mechanism for safety purposes.

These and other objects, aspects and features of the present invention will be better understood from the following detailed description of the preferred embodiment when read in conjunction with the appended drawing figures.

SPECIFIC DESCRIPTION OF THE PREFERRED EMBODIMENT

Figure 1:
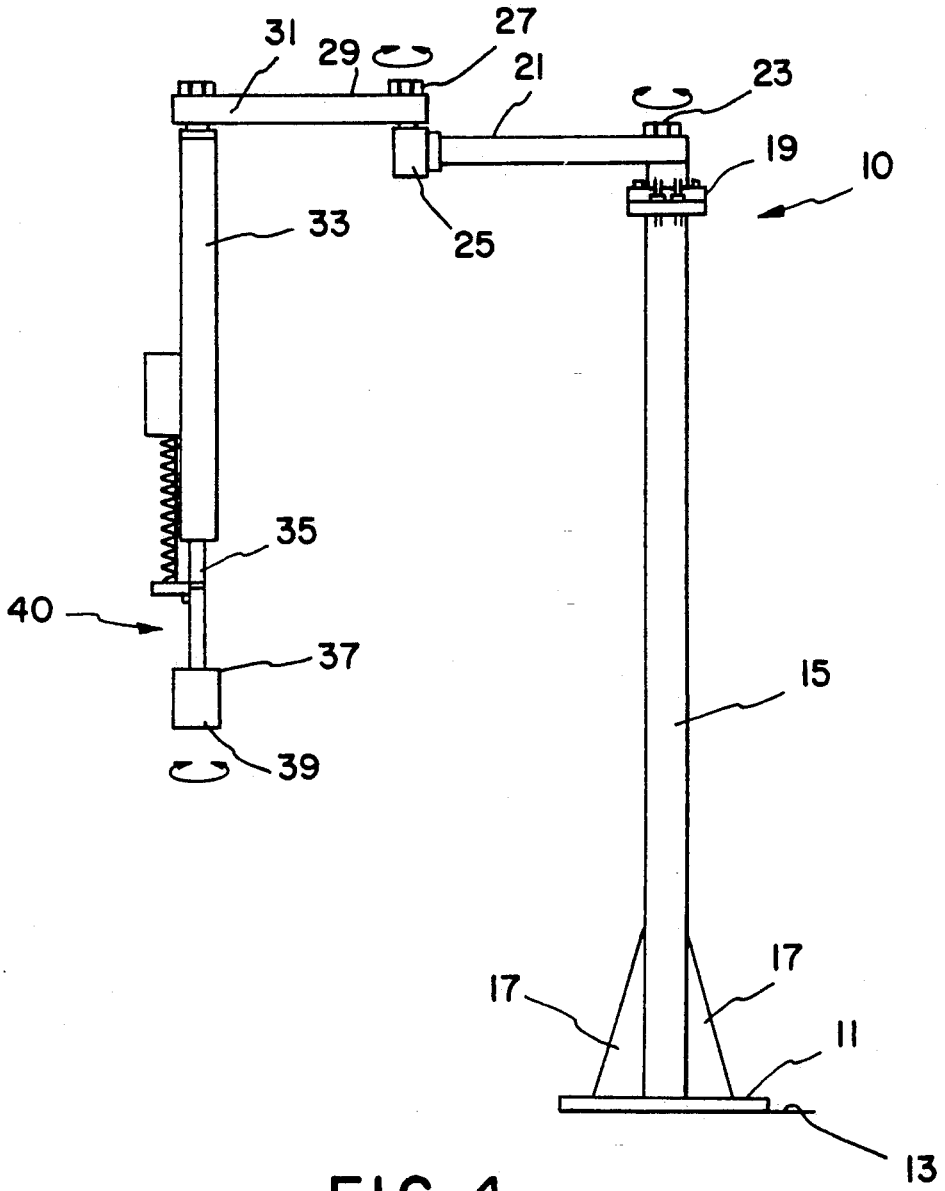
FIG. 1 shows a side view of the present invention.

With reference, first, to FIG. 1, the present invention is generally designated by the reference numeral 10 and is seen to include a base 11 mounted on a ground surface 13 by any suitable means such as, for example, bolts. An upstanding post 15 is suitably attached to the base 11 and is supported in a vertical position by angled pieces 17 which are suitably affixed therebetween by means such as, for example, welds.

The post 15 has an upper termination to which is attached a first pivotable arm 21 which includes bearing box 19 and an opening (not shown) which fits over an upstanding screw 23. The first arm 21 has a distal end carrying a bearing box 25 having a vertically disposed screw 27 which receives an opening (not shown) of a second arm 29.

The distal end 31 of the second arm 29 has fastened thereto a vertically disposed support 33 which extends downwardly as shown in FIG. 1. The support 33 is hollow defining an interior chamber (not shown) which contains (or may comprise) a pneumatic cylinder, a piston reciprocably contained within the cylinder and a piston rod 35 extending downwardly and connected to a control mechanism rod 42 having an end 37 to which is mounted an electromagnet 39 or other end effector such as, for example, a manual hook, a pneumatic gripper or hook, a vacuum lifter or a rotary actuator for a power tool such as a drill.

Figure 4:
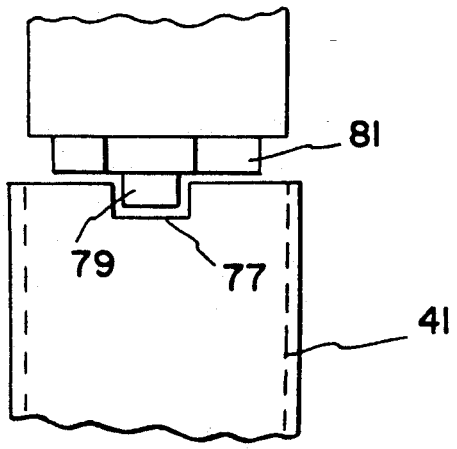
FIG. 4 shows a view of a portion of the structure best shown in FIG. 2 but rotated 90°.
Figure 2:
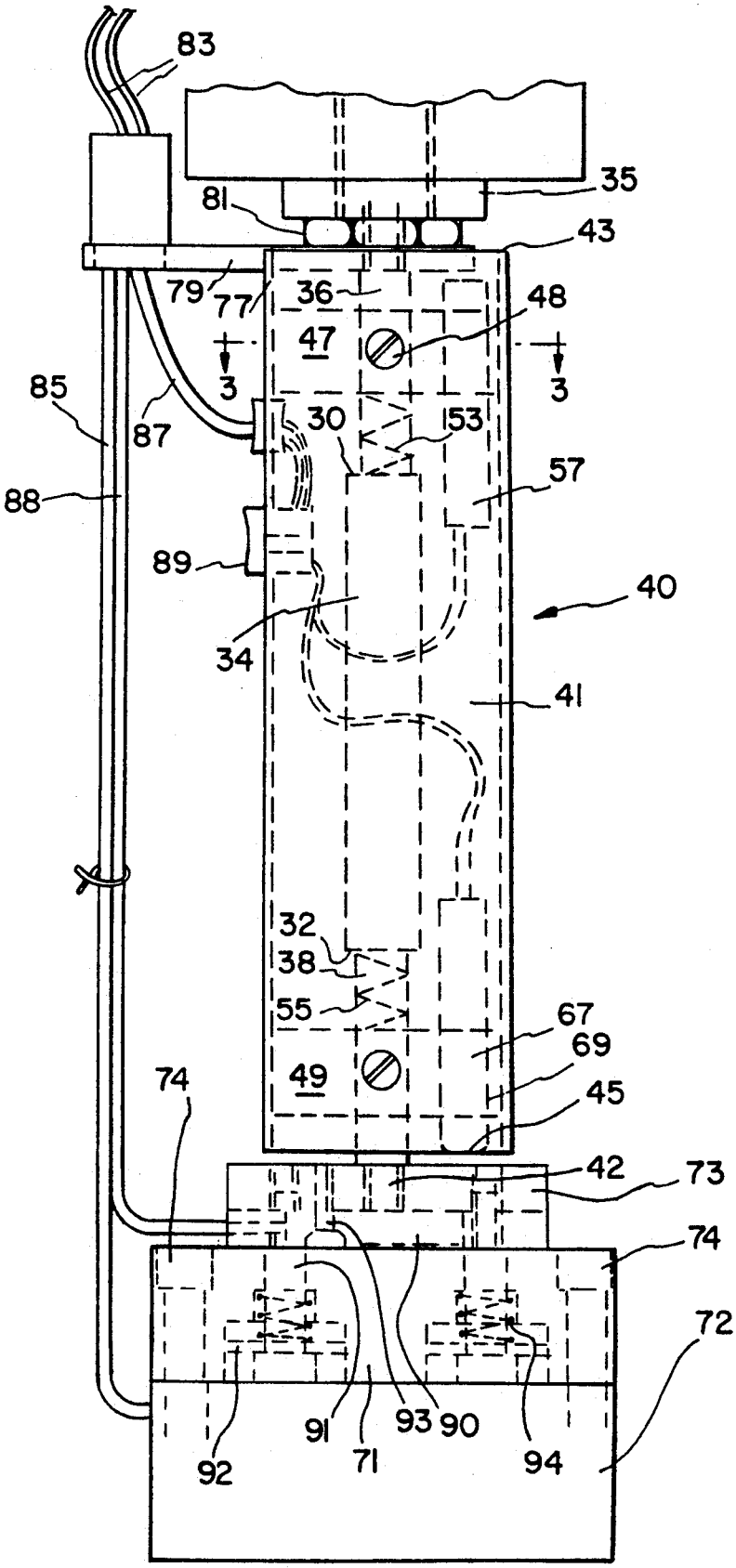
FIG. 2 shows a close-up side view of certain details of the present invention.
Figure 3:
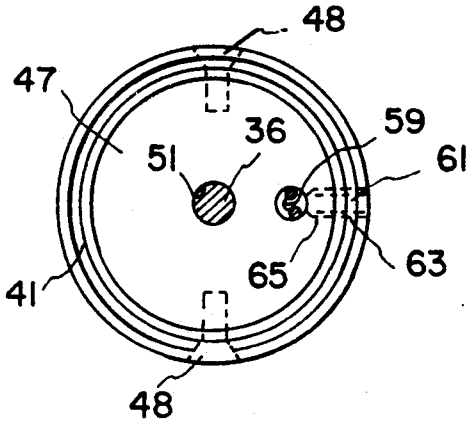
FIG. 3 shows a cross-sectional view along the line III—III of FIG. 2.

A control mechanism is generally designated by the reference numeral 40 and is better seen with reference to FIGS. 2, 3 and 4. With particular reference to FIG. 2, the control mechanism 40 includes an elongated hollow sleeve 41 having an upper termination 43 and a lower termination 45. The control mechanism rod 42 includes narrow portions 36 and 38, a thicker portion 34 and shoulders 30, 32 defining points of intersection between the thinner portions 36, 38 and the thicker portion 34, respectively.

The sleeve 41 carries two bearings 47 and 49 of which the bearing 47 is seen with particular reference to FIG. 3. The bearings 47 and 49 are made of a material such as, for example, ultra-high molecular weight polyethylene. The bearing 47 is provided with a central opening 51 sized to slidably receive the thinner portion 36 of the piston rod. Thus, as the sleeve 41 is moved upwardly or downwardly, the opening 51 of the bearing 47 and the corresponding opening of the bearing 49 slidably engage the portions 36, 38, respectively, of the control mechanism rod 42 to allow the sleeve 41 to reciprocate up and down thereover.

With particular reference to FIG. 2, it is seen that a spring 53 is engaged between the shoulder 30 of the control mechanism rod 42 and an undersurface of the bearing 47. Similarly, a spring 55 is located between the shoulder 32 of the control mechanism rod 42 and an upper surface of the bearing 49. These compression springs 53, 55 serve to balance the position of the sleeve 41 at a neutral position as shown in FIG. 2 for purposes to be described in greater detail hereinafter.

With further reference to FIGS. 2 and 3, it is seen that the bearing 47 carries an inductive proximity switch 57 which, with reference to FIG. 3, is mounted within an opening 59 formed in the bearing 47. A set screw 61 is threadably received through a threaded opening 63 in the sleeve and a further lateral passageway 65 in the bearing so that the set screw 61 may be engaged against an outer wall of the switch 57 to fix the location of the switch 57 with respect to the bearing 47. In a similar fashion, a switch 67 is mounted within an opening 69 in the lower bearing 49 through the use of a similar set screw.

As seen with reference to FIGS. 2 and 3, the bearing 47 is fixedly mounted within the sleeve 41 through the use of mounting screws 48 which extend through openings in the sleeve 41 and are threadably received within blind bores laterally disposed within the bearing 47 as seen, in particular, in FIG. 3. The bearing 49 is mounted within the sleeve 41 in a corresponding fashion.

The inductive proximity switches are so located that, as the sleeve 41 is moved, one switch or the other comes into close proximity with metallic structure provided for that purpose so that through operation of the inductive proximity switch, as should be understood by those skilled in the art, the switch closes. In this regard, the mounting bar 79 is located in a position to cause closure of the upper inductive proximity switch 57 when the sleeve 41 is reciprocated upwardly to a desired degree. Similarly, the metallic mounting plate 73 which carries spring supported target bar 71 (mounting bar) with the electromagnet 72 is so located with respect to the sleeve 41 that downward movement of the sleeve 41 to a desired degree will result in the switch 67 becoming proximate to the mounting plate 73 so that the switch 67 closes. As should be understood, with reference to FIG. 3, the vertical position of the switch 57 may be adjusted through loosening of the set screw 61 and reciprocation of the switch 57 and subsequent tightening of the set screw 61 to fix the position thereof. Corresponding adjustment of the switch 67 may be made.

Use of the inductive proximity switches 57, 67 is an important advance in this environment since such use allows activation of switches without physical contact thereby prolonging the life of the switching mechanism. To further assist this goal, as best seen in FIG. 4, the sleeve 41 has a cut-out portion 77 which encloses mounting bar 79 mounted below a coupling screw 81 which couples the piston rod 35 and the portions of the control mechanism rod 42 designated by the reference numerals 36, 34 and 38 thereto. The bar 79, as seen in FIG. 2, also provides a mounting means for electrical cables 83, 85, 87, 88 as will be explained in greater detail hereinafter. As should be understood, as the sleeve 41 reciprocates over the coupling screw 81, eventually the cut-out portion 77 will engage the bar 79 to preclude further upward movement. The vertical position of the switch 57 is so adjusted with respect to the sleeve 41 that when the limit stop mechanism 77, 79 prevents further upward movement, a gap between the upper end of the switch 57 and the mounting bar 79 is on the order of 1 mm, within the distance wherein the switch 57 will close but preventing physical engagement between the switch 57 and the bar 79. In a similar fashion, the end 45 of the sleeve 41 may engage the upper surface of the mounting plate 73 to provide a limit stop with the bottom surface of the switch 67 being adjusted in its location to provide a similar gap of approximately 1 mm. Interaction between the cut-out portion 77 and the bar 79 also prevents unwanted rotations of sleeve 41.

A further switch 89 may be provided on the outer surface of the sleeve 41, which switch 89 comprises a manually actuable on-off switch. This switch allows activation and deactivation of the electromagnet 72. In alternate constructions, the switch 89 would allow control of a pneumatic gripper or hook, a vacuum lifter or a rotary actuator for a power tool.

The load safety mechanism includes spring 94 supported on tooling mounting bar 71 and may slide up and down on two strong screws 91 bolted to the mounting plate 73. Metal bar 71 is a target for the inductive normally closed proximity switch 90 secured to the mounting plate 73 with screws.

As particularly shown in FIG. 2, the electromagnet 72 may be suitably mounted to the mounting bar 71 through the use of elongated bolts 74. Lifting a load causes the mounting bar to slide down compressing springs 94 until they rest on washers 92. Proximity switch 90 becomes inactive in this position which prevents unwanted dropping of a load.

Figure 5:
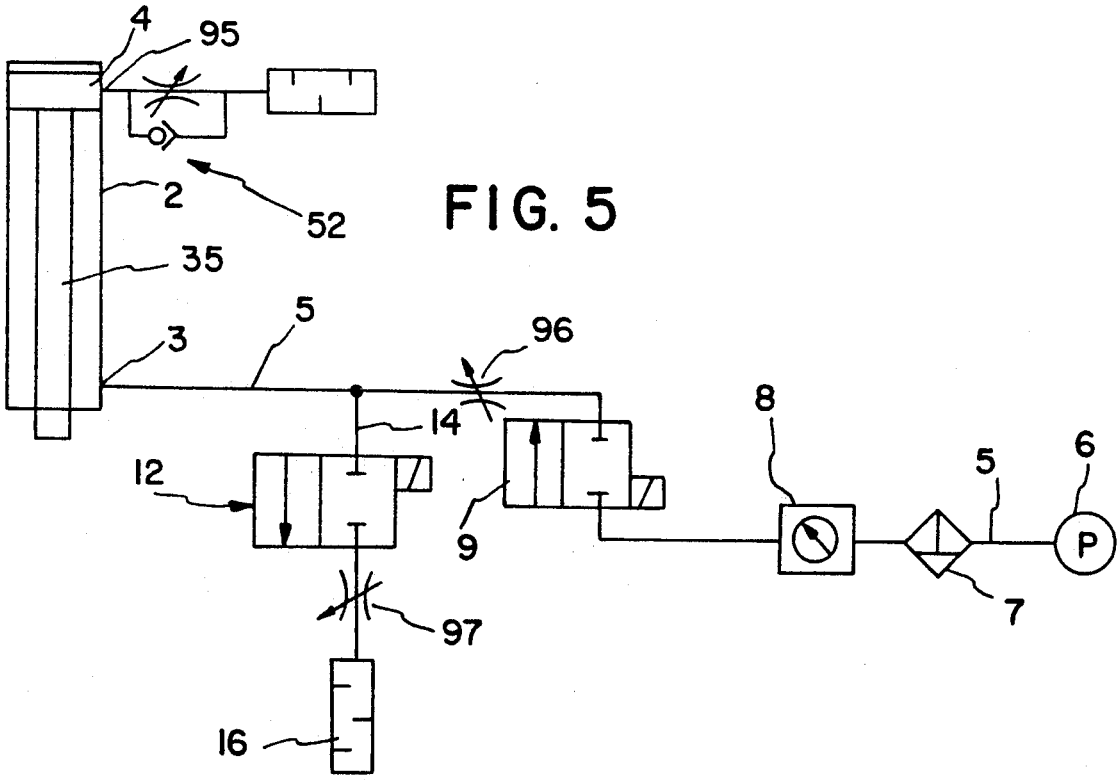
FIG. 5 shows a schematic representation of the pneumatic circuit of the present invention.

With reference to FIG. 5, a pneumatic diagram of the operation of the present invention will now be described. As shown in FIG. 5, the cylinder 2 slidably receives a piston 4 having the piston rod 35 extending downwardly therefrom. If desired, the piston 4 may be received within the cylinder in a manner allowing rotation of the piston rod 35 with respect to the cylinder. For example, the piston and cylinder may each have circular cross-sections. Ports 3 and 95 are provided in the cylinder wall to allow supply and exhaust of air. Fluid passageway 5 connects a source of pressure, shown as the pump 6, to the passageway 5 and thence to the port 3. Also shown in FIG. 5 are an air filter 7, a pressure regulator 8 and adjustable flow check valve 96 to control lifting speed and lock passageway 5 if supply air is lost, a first solenoid valve 9 and a second solenoid valve 12. A flow control valve 52 may be provided to control lifting speed as well.

The first solenoid valve 9 is opened when the switch 57 is closed. The second solenoid valve 12 is opened when the switch 67 is closed. Based upon the operation of the sleeve 41, as should be understood, only one of the solenoid valves 9 or 12 will be open at any given moment. The operation of a solenoid valve should be understood by those skilled in the art.

With the pump 6 operating, movement of the sleeve 41 upwardly in the view of FIG. 2 will cause closure of the switch 57 and opening of the solenoid valve 9 thereby allowing supply of air from the pump 6 via the passageway 5 including filter 7, pressure regulator 8, solenoid valve 9, check valve 96 and port 3 to enter the cylinder 2 beneath the piston 4 at a rate determined by setting flow control check valve 96 to cause the piston 4 and, thereby, the piston rod 35 to be raised upwardly in the view of FIG. 5. Air above the piston 4 leaves the cylinder 2 via port 95 and flow control valve 52 at a rate determined by the setting thereof. If the sleeve 41 is released from the upward position causing closure of the switch 57, operation of the springs 53, 55 will cause the sleeve 41 to adopt the central balanced position shown in FIG. 2 with neither the switch 57 nor the switch 67 closed. In this position, the solenoid valves 9 and 12 are both closed in the position shown in FIG. 5 and air within the cylinder 2 is trapped therein thereby maintaining the position of the piston 41 and piston rod 35 as shown in FIG. 5.

From that position, if the sleeve 41 is moved downwardly to cause closure of the switch 67, such closure opens the valve 12 allowing exhaust of air within the cylinder 2 via the side passageway 14 through the valve 12 and out to atmosphere via the silencer 16. Such exhaust allows the piston 4 and piston rod 35 to move downwardly through the force of gravity. If desired, as shown, an adjustable restrictor 97 may be provided between the valve 12 and silencer 16 to allow adjustment of the rate of descent of the piston 4 and piston rod 35. The present invention provides a simplified construction over prior art constructions by allowing downward movement of the piston 4 via exhaust of the cylinder below rather than via pressurization of the cylinder 2 above the piston 4.

Figure 6:
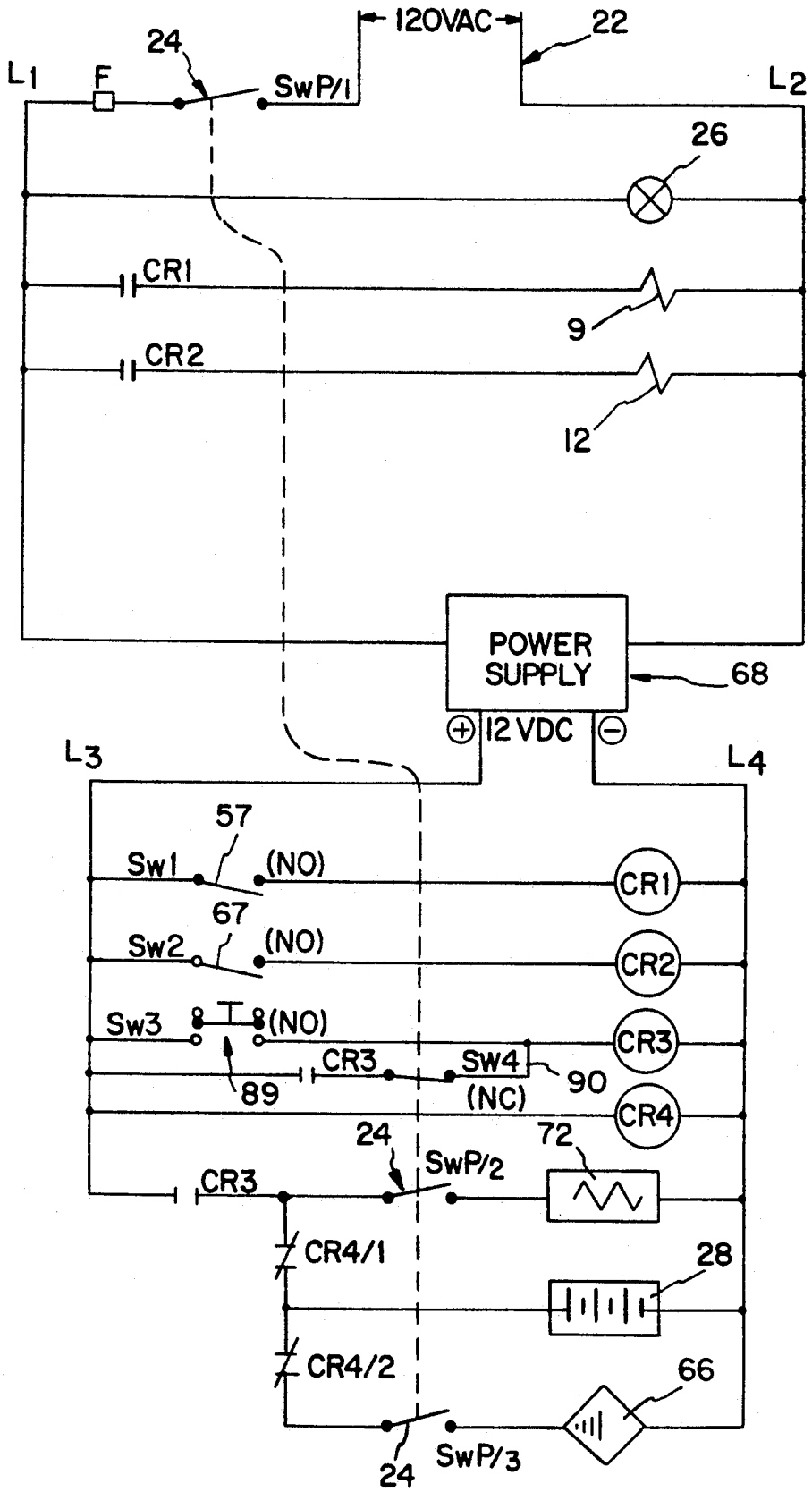
FIG. 6 shows a schematic representation of the electrical circuitry of the present invention.

With reference, now, to FIG. 6, a schematic representation of the electrical circuitry will now be described.

With reference to FIG. 6, it is seen that a 120 volt AC power supply is generally designated by the reference numeral 22 and is activated and deactivated by a three pole power switch 24 which is shown in three separate locations in the diagram of FIG. 6. Also shown in FIG. 6 are the control relays CR1, CR2, CR3 and CR4. The relays CR1, CR2 and CR3 have normally open contacts which are closed when electrical power is applied thereto. The relay CR4 has normally closed contacts which are opened when power is applied thereto and which close in the absence of a power supply.

The circuit shown in FIG. 6 also includes an indicator light 26, a back-up battery 28 and a buzzer 66 which will be described in greater detail hereinafter. Also shown in FIG. 6 is a power supply transformer 68 which transforms the alternating current from the power supply 22 to 12 volt DC power as shown.

As should be understood from FIG. 6, when the switch 57 is closed by raising the sleeve 41 upwardly (FIG. 2), the relay CR1 is also energized causing the solenoid valve 9 to open allowing pressurization of the cylinder 2 under the piston 4 to raise the piston 4. When the sleeve 41 is moved downwardly in the view of FIG. 2 to close the switch 67, the relay CR2 is energized thereby causing opening of the solenoid valve 12 through activation of the associated solenoid to thereby allow exhausting of the cylinder 2 below the piston 4 to allow the piston 4 and piston rod 35 to descend in the view of FIG. 5.

The push button switch 89 may be selectively closed and opened to energize and de-energize, respectively, the relay CR3 and thereby activate and deactivate, respectively, the electromagnet 72. But the electromagnet cannot be deactivated until a load is on a ground surface area and switch 90 is "on" because the relay CR3 will be kept energized through switch 90 and "no" contacts of said relay.

The indicator light 26 is connected across the power switch 24 so that whenever power is applied to the circuit, the indicator light 26 is activated to inform the user. Should power be lost through blowing of a circuit breaker, a power failure, etc., the light 26 will be extinguished and, at the same time, the normally closed contacts of relay CR4 will move to the closed position since power is no longer applied thereacross. Closure of contacts of the relay CR4 will connect the back-up battery 28 across the electromagnet 72 so that the electromagnet 72 will be operative to continue to hold any object which it was holding prior to the power failure. At the same time, as should be understood with reference to FIG. 6, deenergizing of the relay CR4 will result in activation of the buzzer 66 so that the combination of activation of the buzzer 66 and deactivation of the indicator light 26 will inform the user that there has been a power failure and that appropriate action should be taken. For example, the solenoid valve 12 may suitably be provided with a manual override allowing safe lowering of the piston rod 35 to safely lower a load held by the electromagnet 72 to the ground. Then, disconnection of the battery and deactivation of the magnet and the buzzer may be accomplished by turning the power switch 24 off.

Through the use of the present invention, lifting, manipulation, safe carrying and discharge of loads may easily be accomplished by a single person in a work area. The back-up battery of the present invention permits safe operation even during a power failure to prevent injury to the user. The load safety mechanism prevents accidental dropping of a load.

In the preferred embodiment, the sleeve 41 may be made of fiberglass reinforced plastic.

As such, an invention has been disclosed in terms of a preferred embodiment thereof which fulfills each and every one of the objects of the present invention as set forth hereinabove and provides a new and useful load balancing manipulator of great novelty and utility. Of course, various changes, modifications and alterations in the teachings of the present invention may be contemplated by those skilled in the art without departing from the intended spirit and scope thereof.

As such, it is intended that the present invention only be limited by the terms of the appended claims.

I claim:

1. A load balancing manipulator, comprising:

a) a base carrying a support;

b) a pneumatic cylinder vertically mounted on said support and receiving a piston carrying a downwardly extending piston rod carrying a control mechanism rod;

c) an end effector mounted on an end of said control mechanism rod distal from said piston;

d) a first solenoid actuated valve controlling supply of air to said cylinder and a second solenoid actuated valve controlling exhaust of air from said cylinder;

e) an actuator for said valves comprising:

i) an elongated sleeve surrounding a portion of said control mechanism rod adjacent said end effector;

ii) a first switch for said first solenoid valve and a second switch for said second solenoid valve;

iii) said elongated sleeve being spring balanced to a neutral position wherein both of said switches are open, said sleeve being movable upwardly from said neutral position to a first position wherein said first switch is closed and said second switch remains open and being movable downwardly from said neutral position to a second position wherein said second switch is closed and said first switch remains open;

iv) whereby closure of said first switch causes opening of said first valve and closure of said second switch causes opening of said second valve.

2. The invention of claim 1, wherein said support includes at least one horizontally disposed arm pivotally connected to said cylinder.

3. The invention of claim 2, wherein said support further includes a further arm pivotally connected to said first-mentioned arm.

4. The invention of claim 1, wherein said piston is rotatably disposed within said cylinder.

5. The invention of claim 1, wherein said end effector comprises an electromagnet and a load safety mechanism for preventing accidental dropping of a load.

6. The invention of claim 1, wherein said switches are carried by said sleeve.

7. The invention of claim 6, wherein said switches comprise inductive proximity switches.

8. The invention of claim 1, wherein said control mechanism rod includes first and second shoulders, a first spring between said first shoulder and said sleeve and a second spring between said second shoulder and said sleeve.

9. The invention of claim 1, wherein said solenoid actuated valves are powered by an electrical circuit including:

a) a source of 110–120 volt alternating current power;

b) DC power supply transforming said alternating current power to direct current power;

c) a relay with normally open contacts associated with each of said switches; and d) a relay with normally closed contacts and a battery.

10. The invention of claim 9, wherein said end effector comprises an electromagnet.

11. The invention of claim 10, wherein said relay with normally closed contacts is connected into said circuit in a manner whereby should said alternating current power supply be cut off, said normally closed contacts close and thereby connect said battery across said electromagnet and a buzzer to thereby maintain power thereto.

12. The invention of claim 5, wherein said electromagnet is operated by an on-off switch mounted on said sleeve.

13. The invention of claim 5, wherein said load safety mechanism includes a normally closed inductive proximity switch and a moving metallic target.

14. The invention of claim 13, wherein said metallic target comprises a mounting bar for the electromagnet whereby when a load is lifted above a ground surface, said target deactivates said normally closed inductive switch to prevent unwanted demagnetizing of said electromagnet.

* * * * *